US012247587B2

(12) United States Patent
Calma et al.

(10) Patent No.: US 12,247,587 B2
(45) Date of Patent: Mar. 11, 2025

(54) PUMP APPARATUS FOR REDUCING THE SIZE OF SUSPENDED SOLIDS BEFORE PUMPING

(71) Applicant: Weir Minerals Australia Ltd., Artarmon (AU)

(72) Inventors: Cesar Calma, Artarmon (AU); Hugh Duong, Artarmon (AU)

(73) Assignee: Weir Minerals Australia Ltd (AU)

( * ) Notice: Subject to any disclaimer, the term of this patent is extended or adjusted under 35 U.S.C. 154(b) by 134 days.

(21) Appl. No.: 18/015,703

(22) PCT Filed: Aug. 27, 2021

(86) PCT No.: PCT/AU2021/050985
§ 371 (c)(1),
(2) Date: Jan. 11, 2023

(87) PCT Pub. No.: WO2022/040746
PCT Pub. Date: Mar. 3, 2022

(65) Prior Publication Data

US 2023/0287888 A1 Sep. 14, 2023

(30) Foreign Application Priority Data

Aug. 31, 2020 (AU) ..... 2020903105

(51) Int. Cl.
*F04D 7/04* (2006.01)
*F04D 29/42* (2006.01)

(52) U.S. Cl.
CPC ..... *F04D 7/045* (2013.01); *F04D 29/42* (2013.01)

(58) Field of Classification Search
CPC ..... F04D 7/045; F04D 29/42
See application file for complete search history.

(56) References Cited

U.S. PATENT DOCUMENTS

| | | | | |
|---|---|---|---|---|
| 12,066,034 | B2 * | 8/2024 | Glaves | F04D 29/4286 |
| 2002/0191488 | A1 | 12/2002 | Araoka | |
| 2004/0146416 | A1 * | 7/2004 | Burgess | F04D 29/2288 417/415 |
| 2014/0377055 | A1 | 12/2014 | Garvin et al. | |

(Continued)

FOREIGN PATENT DOCUMENTS

| | | | |
|---|---|---|---|
| GB | 2551763 | A | 1/2018 |
| JP | 2002115696 | A | 4/2002 |

*Primary Examiner* — Sabbir Hasan
(74) *Attorney, Agent, or Firm* — MORRISS O'BRYANT COMPAGNI CANNON, PLLC

(57) ABSTRACT

The present invention relates to a pump apparatus for reducing the size of suspended solids in a fluid prior to pumping the fluid through a pump, comprising: a processing chamber having an inner side wall, the inner side wall comprising one or more formations adapted to reduce the size of suspended solids in the fluid; an inlet to the processing chamber having a diameter $D_1$ for receiving the fluid; an outlet from the processing chamber having a diameter $D_2$ for conveying the fluid to the pump; and a central axis extending from a center of the inlet and a center of the outlet, wherein the one or more formations extend in a general direction from the inlet to the outlet, and wherein the processing chamber is frustoconical in shape and $D_1 > D_2$.

14 Claims, 6 Drawing Sheets

(56) References Cited

U.S. PATENT DOCUMENTS

| | | | | |
|---|---|---|---|---|
| 2015/0300371 | A1 | 10/2015 | Mehlhorn | |
| 2018/0100508 | A1 | 4/2018 | Burgess et al. | |
| 2019/0170154 | A1* | 6/2019 | Munro | F04D 29/2288 |
| 2019/0360495 | A1 | 11/2019 | Don et al. | |

* cited by examiner

PUMP APPARATUS FOR REDUCING THE SIZE OF SUSPENDED SOLIDS BEFORE PUMPING

FIELD OF THE INVENTION

The present invention relates to pumping apparatuses, in particular apparatuses suitable for reducing the size of suspended solids in a fluid before or during pumping.

The invention has been developed primarily for reducing the size of scale in a slurry and will be described hereinafter with reference to this application. However, it will be appreciated that the invention is not limited to this particular field of use.

BACKGROUND OF THE INVENTION

Any discussion of the prior art throughout the specification should in no way be considered as an admission that such prior art is widely known or forms part of the common general knowledge in the field.

Pumps are often required to convey fluids that contain suspended solids (e.g. slurries). These suspended solids may include scale particles that build up on pipes or within process vessels and subsequentially dislodge into the fluid stream before pumping. The presence of these suspended solids are problematic in pumping applications as they may cause clogging or damage to wear parts of the pump, e.g. the pump impeller or volute, reducing the net positive suction head and efficiency of the pump.

Previous attempts to address this issue include pipeline screens to catch the suspended solids before entering the pump. However, as these screens catch the suspended solids, the caught solids gradually build up and obstruct the fluid flow to the pump, reducing pumping efficiency. Once this occurs, the pump must be shut down such that the screen may be removed and cleaned. This is critically disruptive to pumping operations, particularly in systems with high amounts of suspended solids.

SUMMARY OF THE INVENTION

It is an object of an embodiment of the invention to obviate or mitigate the abovementioned disadvantages or other disadvantages of the prior art, or to provide a useful alternative.

According to a first aspect of the invention, there is provided a pump apparatus for reducing the size of suspended solids in a fluid prior to pumping the fluid through a pump, comprising: a processing chamber having an inner side wall, the inner side wall comprising one or more formations adapted to reduce the size of suspended solids in the fluid; an inlet to the processing chamber having a diameter $D_1$ for receiving the fluid; an outlet from the processing chamber having a diameter $D_2$ for conveying the fluid to the pump; and a central axis extending from a center of the inlet and a center of the outlet, wherein the one or more formations extend in a general direction from the inlet to the outlet, and wherein the processing chamber is substantially frustoconical in shape and $D_1>D_2$.

In certain embodiments, the pump apparatus is substantially frustoconical in shape In some embodiments, the one or more formations extend from the inlet to the outlet. In certain embodiments, the one or more formations wholly extend from the inlet to the outlet, i.e. the formations begin at the inlet and end at the outlet. In certain embodiments, the one or more formations extend generally along the central axis.

In some embodiments, the processing chamber includes an intermediate section having a diameter $D_3$, wherein $D_2>D_3$.

In some embodiments, the ratio of $D_1$:$D_2$ is in the range of about 1.05:1 to 4:1.

In certain embodiments, the ratio of $D_1$:$D_2$ is in the range of about X:1 to Y:1, where X is selected from: 1.05, 1.10, 1.15, 1.20, 1.25, 1.30, 1.35, 1.40, 1.45, 1.50, 1.55, 1.60, 1.65, 1.70, 1.75, 1.80, 1.85, 1.90, 1.95, 2:0, 2.1, 2.2, 2.3, 2.4, 2.5, 2.6, 2.7, 2.8, 2.9, 3:0, 3.1, 3.2, 3.3, 3.4, 3.5, 3.6, 3.7, 3.8, 3.9; and where Y is selected from (subject to X≤Y): 1.10, 1.15, 1.20, 1.25, 1.30, 1.35, 1.40, 1.45, 1.50, 1.55, 1.60, 1.65, 1.70, 1.75, 1.80, 1.85, 1.90, 1.95, 2:0, 2.1, 2.2, 2.3, 2.4, 2.5, 2.6, 2.7, 2.8, 2.9, 3:0, 3.1, 3.2, 3.3, 3.4, 3.5, 3.6, 3.7, 3.8, 3.9, 4.

In certain embodiments, the ratio of $D_1$:$D_2$ is 1.05:1, 1.10:1, 1.15:1, 1.20:1, 1.25:1, 1.30:1, 1.35:1, 1.40:1, 1.45:1, 1.50:1, 1.55:1, 1.60:1, 1.65:1, 1.70:1, 1.75:1, 1.80:1, 1.85:1, 1.90:1, 1.95:1, 2:0, 2.1:1, 2.2:1, 2.3:1, 2.4:1, 2.5:1, 2.6:1, 2.7:1, 2.8:1, 2.9:1, 3:0, 3.1:1, 3.2:1, 3.3:1, 3.4:1, 3.5:1, 3.6:1, 3.7:1, 3.8:1, 3.9:1, 4:1.

In some embodiments, the one or more formations include a plurality of grooves in the inner side wall.

In some embodiments, the plurality of grooves are spaced circumferentially about the inner side wall, the grooves extending generally in the direction from the inlet to the outlet.

In certain embodiments, the grooves are spaced equidistantly about the circumference of the inner side wall.

In some embodiments, the grooves are curved relative to the central axis.

In some embodiments, the grooves are curved to form a spiraled shape about the central axis.

In some embodiments, the grooves are curved corresponding to an impeller rotation direction of the pump.

In some embodiments, the grooves are curved opposite to an impeller rotation direction of the pump.

In some embodiments, each groove has a variable depth along its length. In certain embodiments, the variable depth increases from an inlet side to a middle point in the processing chamber. In certain embodiments, the variable depth decreases from a middle point in the processing chamber to an outlet side.

In some embodiments, each groove is formed by a plurality of discrete recesses.

In some embodiments, the one or more formations include a plurality of ridges, each ridge spaced between two grooves.

In some embodiments, each groove has a variable width along its length.

In some embodiments, the inlet is frustoconical in shape.

According to a second aspect of the invention, there is provided an assembly for reducing the size of suspended solids in a fluid prior to pumping the fluid through a pump, comprising: a pump apparatus in accordance with the first aspect; and a rotatable projection disposed within the processing chamber of the pump apparatus, the rotatable projecting including an outer wall which is spaced from the inner side wall of the processing chamber.

In some embodiments, the rotatable projection protrudes into the processing chamber through the outlet of the pump apparatus.

In some embodiments, the rotatable projection forms part of an impeller of the pump.

In some embodiments, the outer wall of the rotatable projection comprises one or more formations on the outer wall adapted to reduce the size of suspended solids in the fluid.

In some embodiments, the formations of the rotatable projection are substantially linear and aligned with the central axis.

In some embodiments, the formations of the rotatable projection have a curvature substantially corresponding to the formations of the processing chamber.

In certain embodiments, the rotatable projection has a generally ovular-shaped cross-section, such that a space between the outer wall of the rotatable projection and the inner side wall varies as the rotatable projection rotates.

Other aspects, features, and advantages will become apparent from the following Detailed Description when taken in conjunction with the accompanying drawings, which are a part of this disclosure and which illustrate, by way of example, principles of the various embodiments.

BRIEF DESCRIPTION OF DRAWINGS

Preferred embodiments of the invention will now be described, by way of example only, with reference to the accompanying drawings in which.

DETAILED DESCRIPTION

Figure 1:
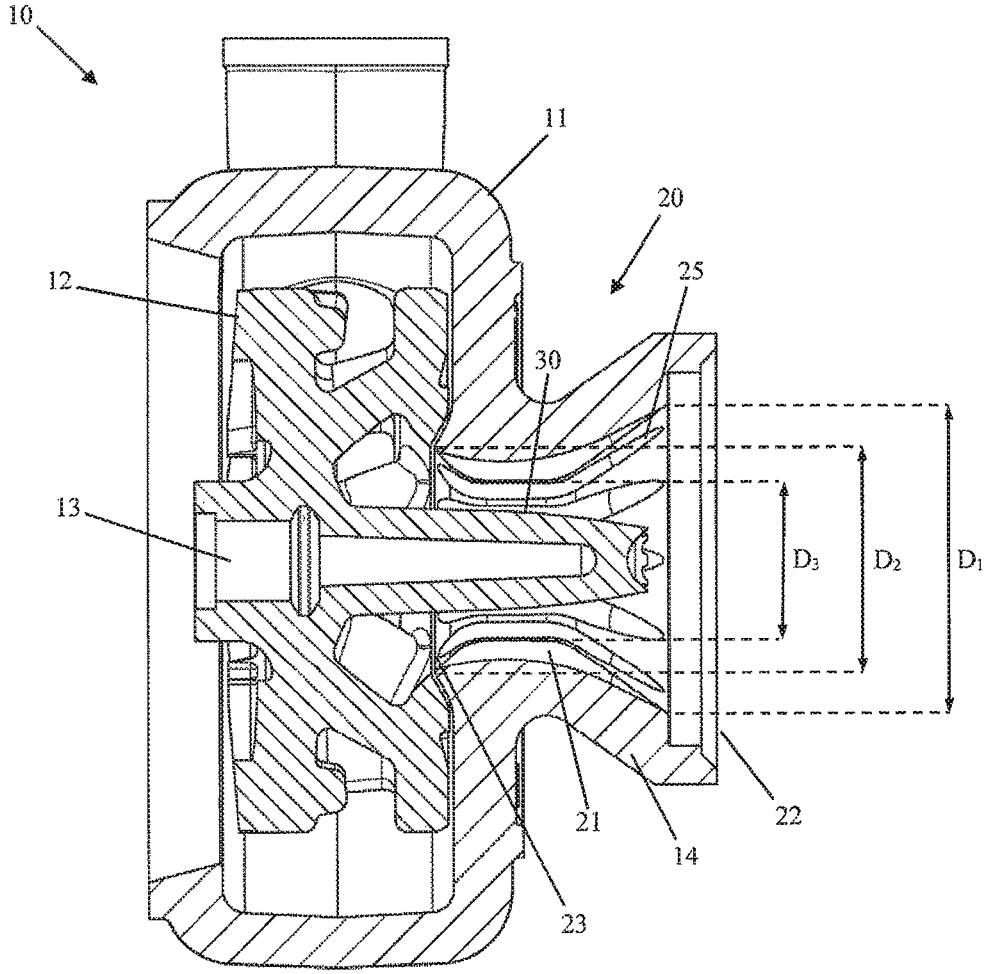
FIG. 1 illustrates a schematic sectional side view of a pump according to a first preferred embodiment of the invention.

The following embodiments are described by way of example only in order to provide a more detailed understanding of certain aspects of the invention. It is to be understood that other embodiments are contemplated, and it is not intended that the disclosed invention is limited to the following description.

Specifically, while the following examples have been directed to particular pump arrangements, it will be appreciated that pump arrangements with alternative or modified components could be envisioned including the core aspects of the invention.

FIGS. 1-6 illustrate three preferred embodiments of the invention. In each embodiment, the Figures show a pump 10 having a pump casing 11, an impeller 12 disposed within the pump casing 11 and being operatively mounted to a drive shaft 13, a pump inlet/throatbush 14 through which a fluid (e.g. a slurry) may enter the pump 10 to be pumped to a pump outlet 15. The pump apparatus 20 of the invention particularly concerns the throatbush 14 and the impeller 12, and the interaction thereof.

The pump apparatus 20 is adapted for reducing the suspended solids in the fluid prior to pumping through the pump 10. The pump apparatus 20 comprises a processing chamber 21 with an inlet 22 for receiving the fluid, an outlet 23 for conveying the fluid to the pump, and an inner side wall 24 extending therebetween. The inner side wall 24 comprises one or more formations, shown as grooves 25, for reducing the size of suspended solids or scale in the fluid by, for example, wedging and crushing the particles between the stationary and rotating parts and/or providing localized areas of turbulent flow.

The grooves 25 are shown extending from the inlet 22 to the outlet 23 and equidistantly spaced about the circumference of the inner side wall 24; however, in alternative embodiments the formations may be spaced or shaped differently (e.g. having a variable depth and/or width along their length), or curved about a central axis extending from a center of the inlet 22 and a center of the outlet 23. In further alternative embodiments, the formations may include ridges, or a combination of ridges and grooves.

The processing chamber 21 is dimensioned to be substantially frustoconical in shape, such that the inlet 22 has a diameter $D_1$ that is larger than a diameter $D_2$ of the outlet 23. The ratio of $D_1$:$D_2$ is preferably in the range of about 1.01:1 to 4:1.

Optionally, and as illustrated in each of the FIGS. 1-5, the impeller 12 comprises a rotatable portion 30 which extends into the processing chamber 21 and assists with the reducing the size of suspended solids in the fluid. The rotatable portion 30 includes further formations 31 on its outer wall, the formations 31 being substantially linear and aligned with the central axis. Alternatively, the formations 31 may be curved substantially corresponding to the curvature of the formations 25 of the processing chamber 21.

Figure 2:
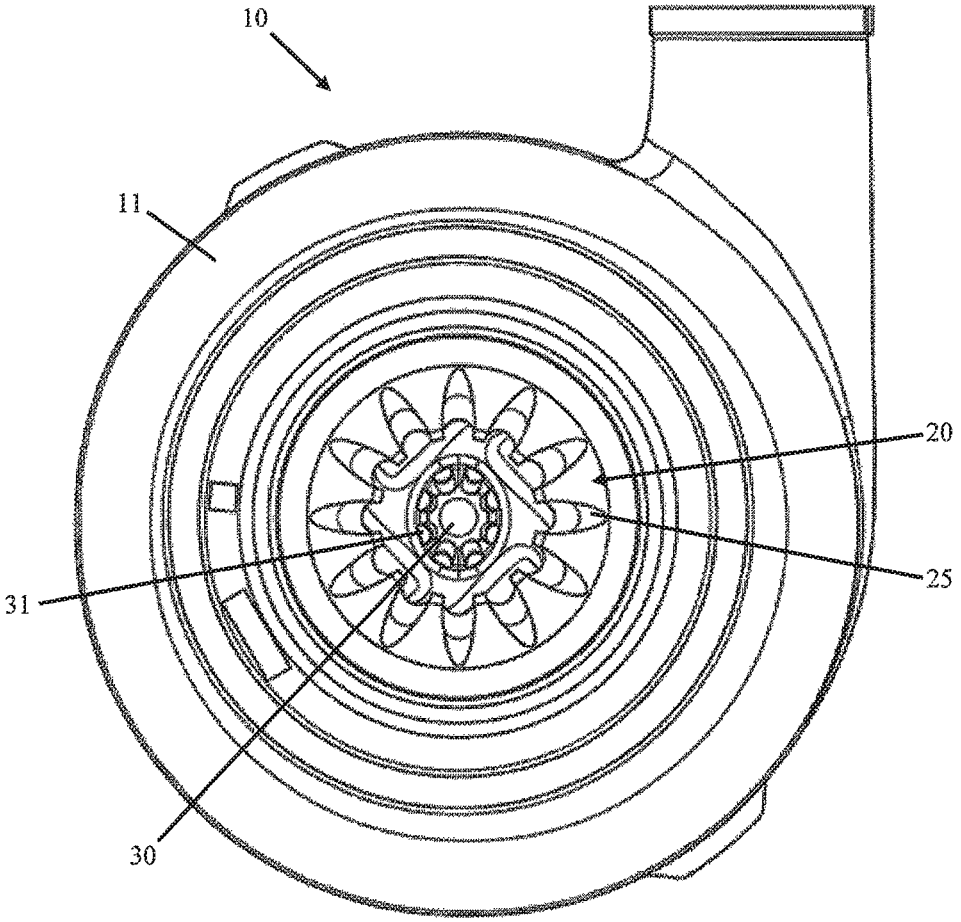
FIG. 2 illustrates a front view of the pump of FIG. 1.
Figure 4:
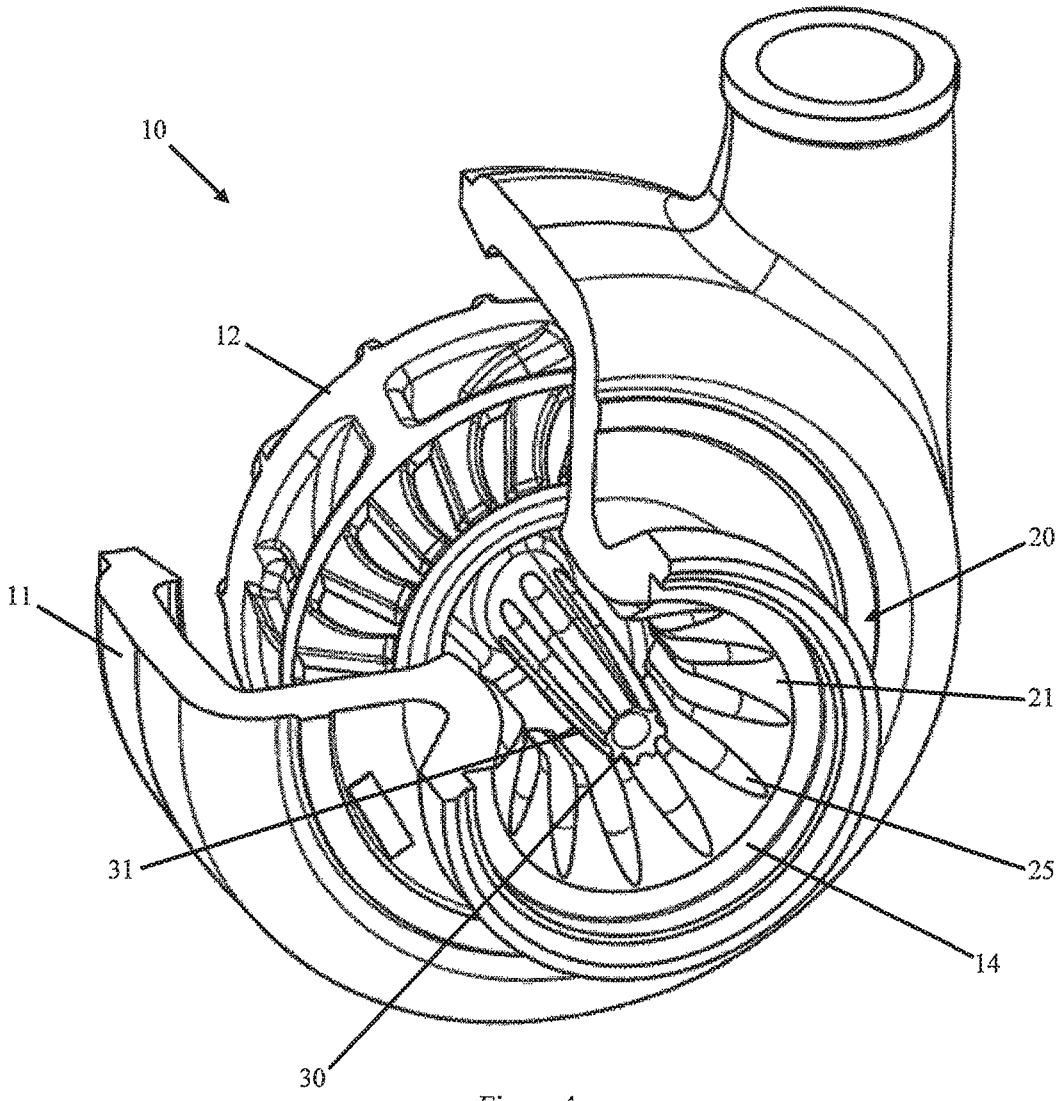
FIG. 4 illustrates a partial cutaway perspective view of the pump of FIGS. 1 and 2.

As illustrated in FIGS. 1, 2 and 4, the grooves may extend linearly relative to the central axis. In this embodiment, the invention functions to reduce the size of suspended solids in the fluid by providing for turbulent/resistive forces to the suspended solids as the fluid passed over the grooves 25. The frustoconical or flared design of the processing chamber 21 provides sufficient surface area for this process to occur and increases the overall Net Positive Suction Head (NPSH) of the pump (which may compensate for any NPSH losses from the rotatable portion 30 extending beyond a normal impeller profile). These forces break up the suspended solids into smaller pieces, which may then be pumped without disrupting the pumping operations and reducing any potential damage to the wear parts of the pump (compared to pumping the original fluid and suspended solids). The formations 31, which are driven by the rotation of the impeller 12, add further forces to reduce the size of the suspended solids.

In one example, a pump apparatus according to the present invention was produced for use with a Weir Warman® AH® 4/3 pump, where $D_1$=149 mm, $D_2$=77 mm and a variable groove depth reaching a maximum depth of 9 mm in a middle section of the apparatus. This example pump was found to be successful in reducing the size of suspended solids in the pumped fluid when compared with a standard Weir Warman® AH® 4/3 pump (without the pump apparatus). The example pump was further found to incur wear at a reduced rate compared to the sample pump, due to the reduced size of the suspended solids being pumped.

Figure 3:
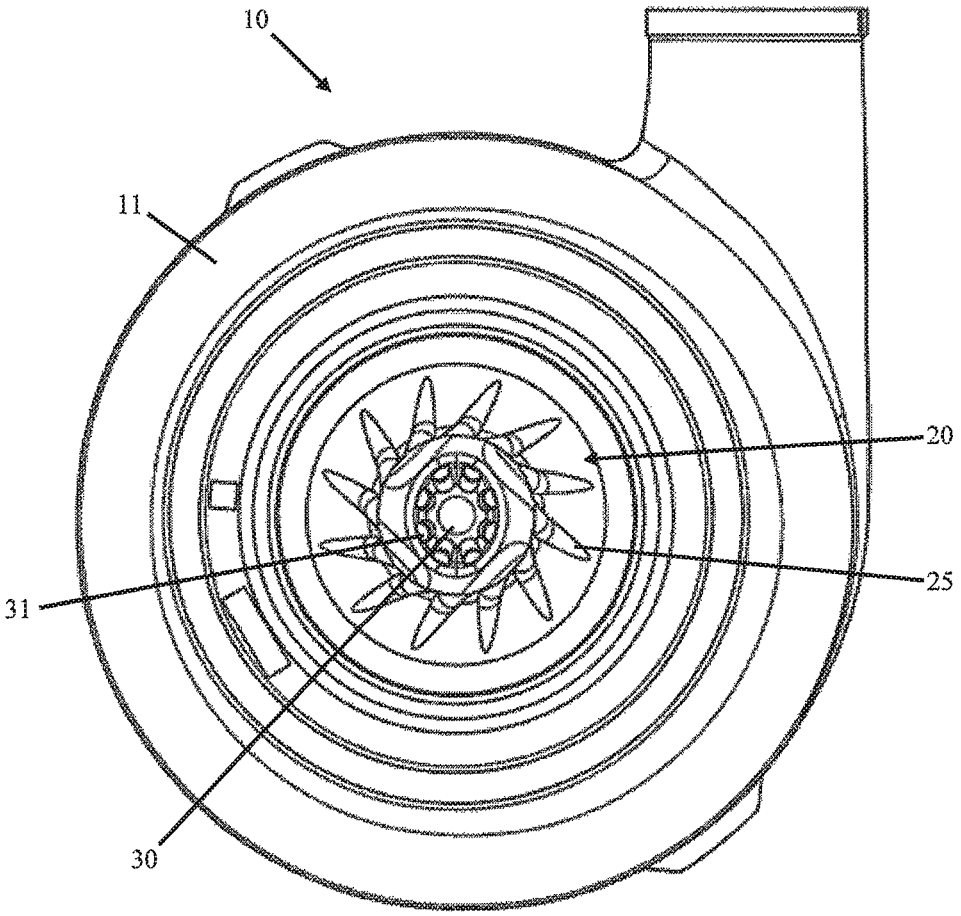
FIG. 3 illustrates a front view of a pump according to a second preferred embodiment of the invention.
Figure 5:
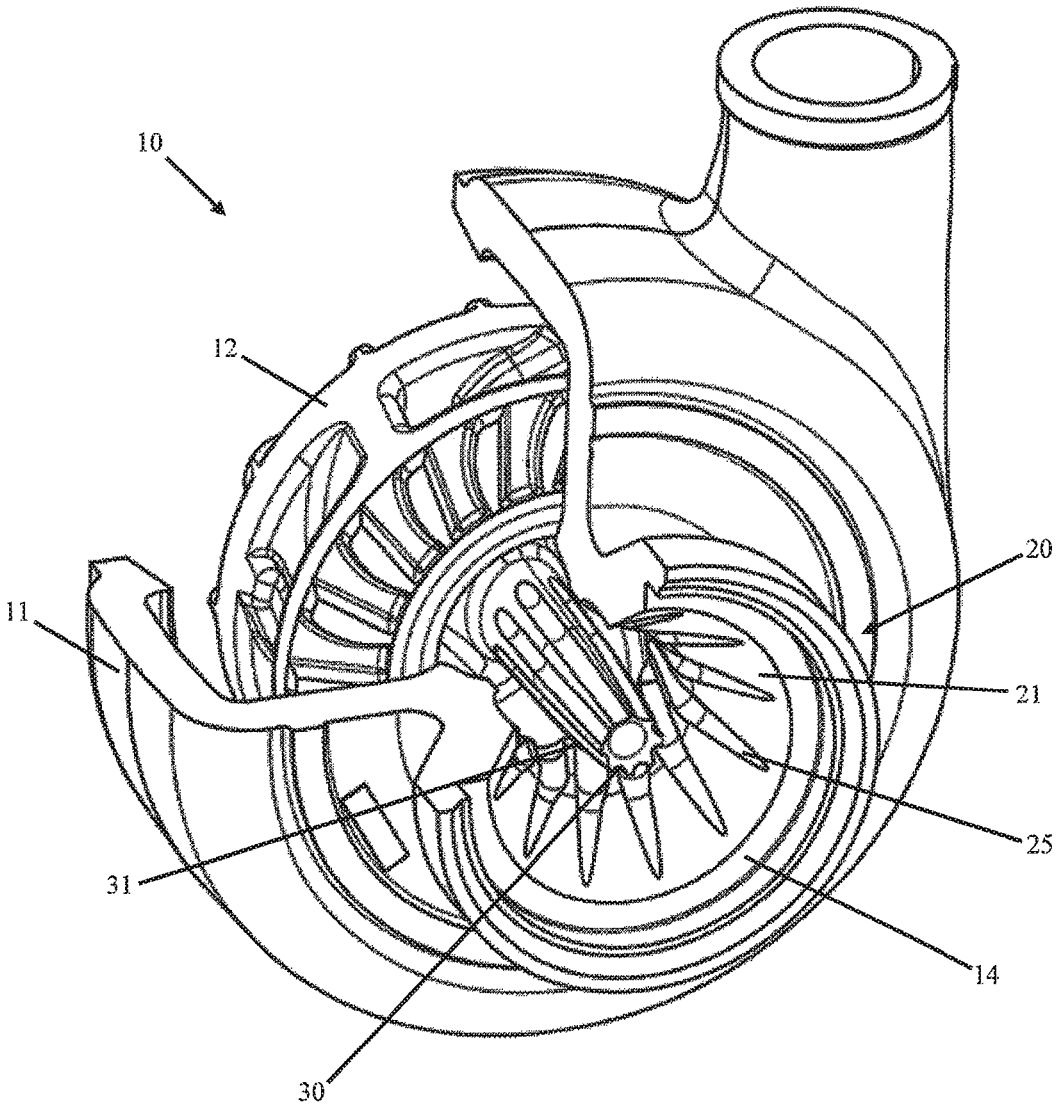
FIG. 5 illustrates a partial cutaway perspective view of the pump of FIG. 3.
Figure 6:
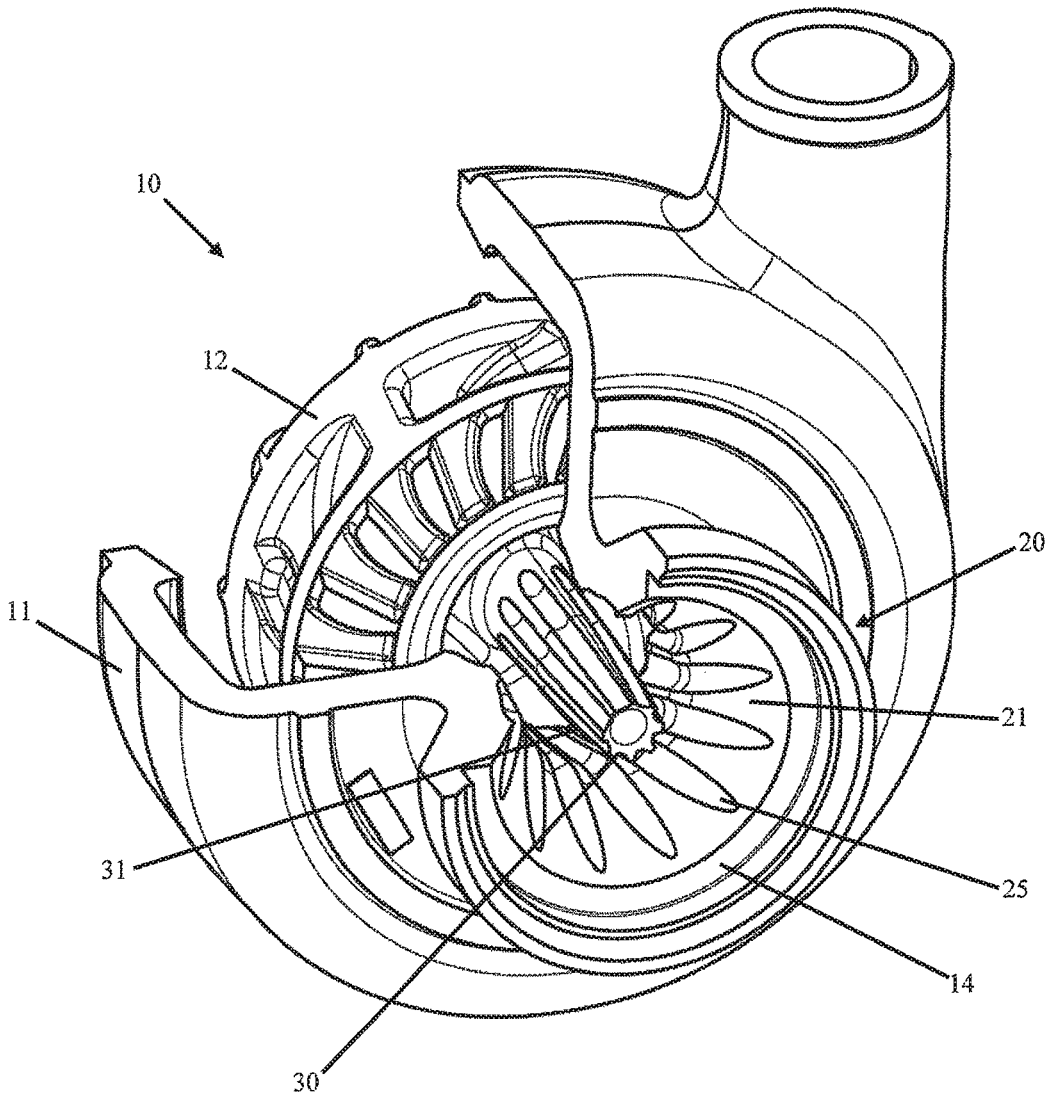
FIG. 6 illustrates a partial cutaway perspective view of a pump according to a third preferred embodiment of the invention.

Further embodiment is illustrated in FIGS. 3, 5 and 6, wherein the grooves extend spirally along the inner side wall 24 relative to the central axis. In particular, FIGS. 3 and 5 illustrate the grooves being curved corresponding to an impeller direction of the pump, while FIG. 6 illustrates the grooves being curved opposite to an impeller direction of the pump. These embodiments function similarly to the linear groove version; however, the spiral design extends the groove 25 length relative to the linear version and provides for an increased area to reduce the size of the suspending solids. Accordingly, these designs may improve the flow of the fluid mixture with suspended solids through the pump resulting in a finer suspended solid, an increased pumping efficiency, and reduced wear on the pump 10 over time.

In some embodiments (shown in FIG. 1) the processing chamber 21 includes an intermediate section between the inlet 22 and the outlet 23, where the intermediate section has a diameter $D_3$ being smaller than both $D_1$ and $D_2$. In alternative embodiments, the inlet may be frustoconical in shape (not shown).

Throughout this specification and the claims which follow, the singular forms "a", "an" and "the" include plural referents unless the context clearly dictates otherwise. Furthermore, unless the context clearly requires otherwise, throughout the description and the claims, the words "comprise", "comprising", and the like are to be construed in an inclusive sense as opposed to an exclusive or exhaustive sense; that is to say, in the sense of "including, but not limited to".

Ranges may be expressed herein as from "about" or "approximately" one particular value and/or to "about" or "approximately" another particular value. When such a range is expressed, other example embodiments include from the one particular value and/or to the other particular value, or to any singular value or value range between the two mentioned values. Moreover, ranges may be expressed herein as "more than", "more than or equal to", "less than" or "less than or equal to" a particular value. When such a range is expressed, other example embodiments include any singular value or subset value range that lies within the initial value range.

Although the invention has been described with reference to specific embodiments, it will be appreciated by those skilled in the art that the invention may be embodied in many other forms. For example, it will be appreciated that many combinations, alterations, modifications, variations and substitutions will be apparent to those skilled in the art without departing from the scope of the present invention, and it is intended for this application to embrace all such combinations, alterations, modifications, variations and substitutions. Moreover, wherein specific integers are mentioned which have known equivalents in the art to which the invention relates, such known equivalents are deemed to be incorporated herein as if individually set forth.

The invention claimed is:

1. A pump apparatus for reducing the size of suspended solids in a fluid prior to pumping the fluid through a pump, comprising:

a processing chamber having an inner side wall, the inner side wall comprising one or more formations spaced circumferentially about the inner side wall and adapted to reduce the size of the suspended solids in the fluid;

an inlet to the processing chamber having a diameter $D_1$ for receiving the fluid;

an outlet from the processing chamber having a diameter $D_2$ for conveying the fluid to the pump; and a central axis extending from a center of the inlet and a center of the outlet, wherein the one or more formations include a plurality of grooves curved to form a spiral shape about the central axis extending in a general direction from the inlet to the outlet, and wherein the processing chamber is substantially frustoconical in shape and $D_1>D_2$, and wherein the ratio of $D_1$ to $D_2$ is in the range of about 1.5:1 to 4:1, and wherein the processing chamber includes an intermediate section having a diameter $D_3$, wherein $D_2>D_3$.

2. The pump apparatus of claim 1, wherein the plurality of grooves are curved corresponding to an impeller rotation direction of the pump.

3. The pump apparatus of claim 1, wherein the plurality of grooves are curved opposite to an impeller rotation direction of the pump.

4. The pump apparatus of claim 1, wherein each groove of the plurality of grooves has a variable depth along its length.

5. The pump apparatus of claim 4, wherein each groove is formed by a plurality of discrete recesses.

6. The pump apparatus of claim 1, wherein the one or more formations include a plurality of ridges, each ridge spaced between two grooves.

7. The pump apparatus of claim 1, wherein each groove of the plurality of grooves has a variable width along its length.

8. The pump apparatus of claim 1, wherein the inlet is frustoconical in shape.

9. An assembly for reducing the size of suspended solids in a fluid prior to pumping the fluid through a pump, comprising:

a pump apparatus in accordance with claim 1; and a rotatable projection disposed within the processing chamber of the pump apparatus, the rotatable projection including an outer wall which is spaced from the inner side wall of the processing chamber.

10. The assembly of claim 9, wherein the rotatable projection protrudes into the processing chamber through the outlet of the pump apparatus.

11. The assembly of claim 10, wherein the rotatable projection forms part of an impeller of the pump.

12. The assembly of claim 9, wherein the outer wall of the rotatable projection comprises one or more formations on the outer wall adapted to reduce the size of suspended solids in the fluid.

13. The assembly of claim 12, wherein the one or more formations of the rotatable projection are substantially linear and aligned with the central axis.

14. The assembly of claim 12, wherein the one or more formations of the rotatable projection have a curvature substantially corresponding to the formations of the processing chamber.

* * * * *